United States Patent [19]

DeLaurentis

[11] 4,381,209

[45] Apr. 26, 1983

[54] METHOD OF CURING A NON-METALLIC BAND

[75] Inventor: Angelo A. DeLaurentis, South Pymatuning, Pa.

[73] Assignee: Westinghouse Electric Corp., Pittsburgh, Pa.

[21] Appl. No.: 365,437

[22] Filed: Apr. 5, 1982

Related U.S. Application Data

[60] Division of Ser. No. 216,213, Dec. 12, 1980, Pat. No. 4,345,232, which is a continuation of Ser. No. 22,126, Mar. 20, 1979, abandoned.

[51] Int. Cl.[3] ..... B65H 8/00

[52] U.S. Cl. ..... 156/162; 156/185; 156/212; 156/307.1

[58] Field of Search ..... 156/162, 165, 161, 184–185, 156/307.1, 296, 382, 381; 336/210

[56] References Cited

U.S. PATENT DOCUMENTS

| | | | |
|---|---|---|---|
| 2,985,858 | 5/1961 | Lattiggori | 336/210 |
| 3,007,124 | 10/1961 | Robinson | 336/210 X |
| 4,341,972 | 7/1982 | Penn et al. | 156/162 X |

*Primary Examiner*—David A. Simmons
*Attorney, Agent, or Firm*—D. R. Lackey

[57] ABSTRACT

A method of curing a non-metallic band impregnated with resin, which is wrapped about a leg portion of a magnetic core such that it overlaps a portion of itself, including the steps of tensioning the band, curing resin in the overlapped portion, and subsequently curing the remainder of the resin in the band in an oxygen-free atmosphere.

5 Claims, 4 Drawing Figures

METHOD OF CURING A NON-METALLIC BAND

This is a division of application Ser. No. 216,213, filed Dec. 12, 1980, now U.S. Pat. No. 4,341,232, which is a continuation of application Ser. No. 022,126 filed Mar. 20, 1979, now abandoned.

BACKGROUND OF THE INVENTION

1. Field of the Invention

The invention relates in general to a magnetic core for electrical inductive apparatus, and in particular to a non-conductive core band for such apparatus.

2. Description of the Prior Art

Electrical inductive apparatus, such as transformers and electrical reactors, include a magnetic core consisting of a plurality of electrical steel plates, called punchings, that are stacked in groups over a frame work and are bound together by some means. The usual means employed is a plurality of core bolt studs. The core bolt studs have the dual purpose of acting as guide pins during core assembly, and clamping the core punchings together after assembly. It follows that assembly of the transformer or electrical apparatus must include the additional step of punching the bolt holes and insulating the bolts to prevent short circuits in the magnetic flux path.

Besides the increased labor and materials necessary for bolting the core punchings together, there are numerous other disadvantages, including:

(1) When the punchings are placed over the bolts during assembly, they may not fall flat, thus tending to bind by friction and hang up on the bolt sides and the bolt threads. This sets up punching waves in the core at the bolt stud location. Clamping this wavey structure after the assembly is completed stresses the stress sensitive magnetic material, increasing core losses.

(2) The punchings have the bolt holes pierced through them prior to assembly. When the die employed in the piercing operation becomes slightly worn, a slight bolt hole edge burr may be formed. During assembly, this burr may scratch through the insulating layer on neighboring punchings and cause a short circuit within the core.

(3) Metallic core bolts must be insulated from the punchings and from the end frame. Any subsequent breakdown of core bolt insulation during the lifetime of the induction apparatus may cause a short circuit in the magnetic flux path, generating heat, high core loss and noise, and eventually transformer failure.

(4) Bolt holes in the punchings cause flux crowding which increases the core loss value for a given KVA rating and prevents the efficient use of superior grades of grain oriented steel for the core medium. Thus, improved electrical steel cannot be efficiently used to build an improved core due to the high destruction factor of the bolted core structure. Destruction factor being a measurement of the flux carrying capacity of the raw material used in the core minus the flux carrying capacity of the finished product used in the core after assembly.

(5) Bolting restricts oil circulation by crimping the oil ducts near the bolts.

Bolting of magnetic core punchings requires increased labor and materials. It may also impair the physical and magnetic qualities of the core, and promote uneven punching stack space factor and joint closure.

Bolting of the magnetic core punchings may also increase the operating noise level of a transformer.

A metal band would seem an ideal replacement for the bolting process as it has great tension capability and resistance to abrasive wear. However, closed metal loops in the vicinity of a magnetic core present a short circuited winding to the induction device.

Prior art banding arrangements for eliminating the undesirable consequences of bolting the core punchings without the use of a solid metal band have included the use of a metal band with an insulating link, and the use of a non-metallic band with a metallic fastener. Both arrangements require the assembly of a band consisting of different materials and coupling elements. Both bands require a larger over-all band height due to the thickness of the metal fastener of the insulating link. Both bands contain metal, and any metal located in the proximate vicinity of a flux circuit is potentially detrimental as it is subject to electrical stress concentrations and corona discharges.

Accordingly, it would be desirable to provide a completely non-metallic core band including non-metallic fastening means approximating the strength, tension and abrasive wear resistance of a steel band.

SUMMARY OF THE INVENTION

Briefly, the present invention is a new and improved arrangement for banding a plurality of magnetic steel laminations into a magnetic core suitable for use in a transformer, or other electrical inducation apparatus. More specifically, the invention includes a completely non-metallic core band, including non-metallic fastening means for joining the core band to itself. When a core band of multiple layers is desired, the non-metallic core band layers may be combined into a multi-layer unit wrap. The individual layers of the unit wrap are attached to each other at intervals along the core band linear length, enabling the unit core band to be inventoried for subsequent use. All band wrap layers are fastened and sealed, thus acting as individual bands for better hold strength and protection.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
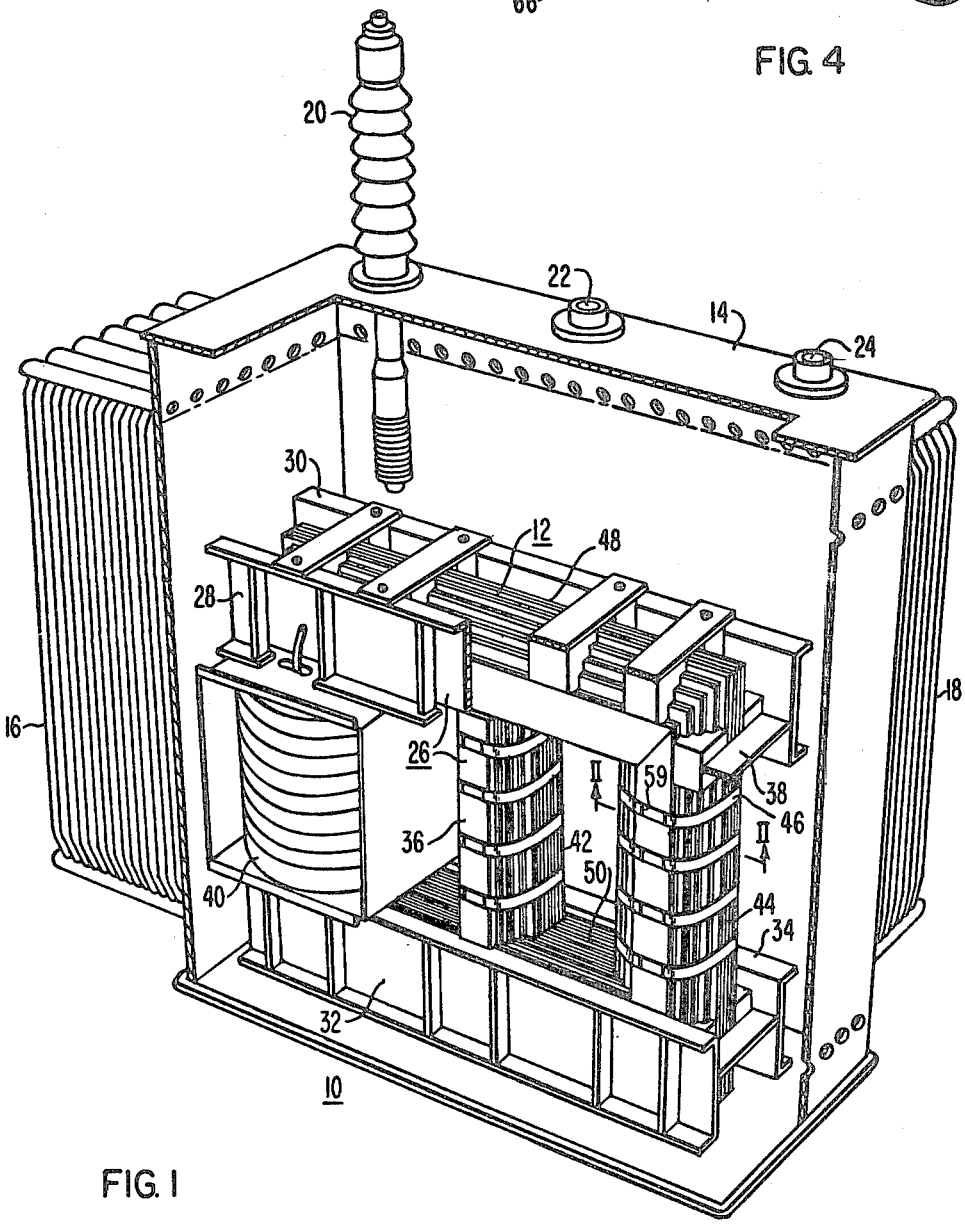
FIG. 1 is a perspective view of electrical inductive apparatus which may be constructed according to the teachings of the invention with parts cut away for clarity.

Referring now to the drawings and FIG. 1 in particular, there is shown a power transformer 10 of the type which may be constructed according to the teachings of the invention. Power transformer 10 is illustrated as being of the core-form type having a cruciform-type laminated magnetic core 12. The transformer 10 includes a casing 14, coolers 16 and 18, the electrical bushings, such as bushing 20. Additional bushings would normally be mounted on the casing 14 by the bushing attachments 22 and 24.

The magnetic core 12, which includes a plurality of leg portions, such as legs 42 and 44, and upper and lower yoke portions 48 and 50, respectively, is enclosed by a frame structure 26 which includes the end frames 28, 30, 32 and 34, lock plates, such as the lock plate 36, and the punching braces 38. A winding structure 40 is disposed around one of the legs of the core 12. Similar winding structures would normally be disposed around the core legs 42 and 44 in a complete transformer of the type shown in FIG. 1.

The punchings of the magnetic core 12, leg and/or yoke portions, are secured by non-metallic bands, such as band 46, and fastening means 59 made of insulating material to be described more fully below.

Typical power transformer cores are built with electrical steel punchings that are stacked into leg or yoke portions. The leg portion is the core member upon which the coils or windings of the transformer are disposed, with the core leg O.D. and the winding I.D. built to close tolerances in order to keep flux leakage to a minimum. Thus, any fastening device replacing the core bolting procedures must have a minimal wall thickness so as not to interfere with winding placement. Other criteria for the core band are high tensile strength, resistance to wear, reliability and reproducibility.

Figure 2:
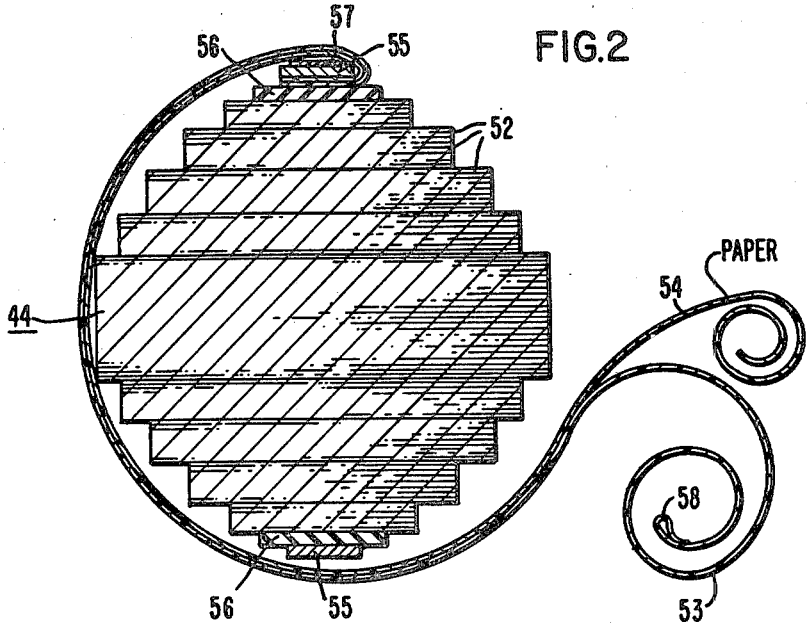
FIGS. 2 and 3 are cross-sectional views of the electrical inductive apparatus shown in FIG. 1, taken between and in the direction of arrows II—II, illustrating a new and improved non-metallic core band and fastening means according to the teachings of the invention.
Figure 3:
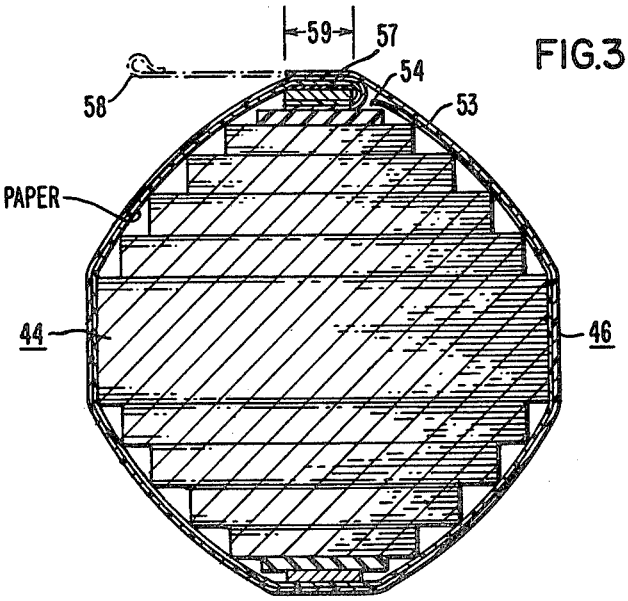

Referring now to FIGS. 2 and 3, there is shown, in cross-section, core leg member 44 of transformer 10. Leg member 44 includes a plurality of sheets of electrical steel laminations 52 held together in stacked, cylindrical fashion by a non-metallic core band system which includes a non-metallic core band 53. Band 53 may be made of a unidirectional continuous filament tape or web belt of a high strength and heat resistant material, such as fiberglass, glass filaments or aramid fibers, etc. that have been impregnated with a chemical resin. The resin may be a polyester, epoxy, phenolic, silicone, or any equivalent thermosetting resin in a B-stage controlled polymer phase combined with a latent catalyst. The core band 53 will then react to heat or chemicals to polymerize at the resulting core band joint, after the core band has been wrapped about the leg member, lapped, and tensioned. The bandwidth is determined by the tensile strength desired. A 2" width is used in the preferred embodiment, but other widths may be selected. Band wall thickness should be minimized for the reasons set forth above. A thickness of 0.060 inch is used in the preferred embodiment but other dimensions would work just as well. The band length of course must be sufficient to encircle the core plus the amount necessary for fastening and tensioning the band. When applying the core band system around the core section, a protective wrap 54, such as a paper liner, may be used to prevent damage to the core band 53 from the punching edges. After the core leg punchings 52 have been stacked in the cruciform arrangement illustrated, or in a rectangular cross-section, with lock plates 55 and lock plate insertion 56 in place, an end of core band 53 and an end of paper liner 54 are secured between one of the lock plates 55 and its insulation 56. Next, the core band 53 and paper liner 54 are folded back over the lock plate 55 and around the stacked punchings 52. As shown in FIG. 3, a thermal pad 57 is inserted between the core band 53 and the paper liner 54 to prevent the lock plate 55 and core from acting as a heat sink and reducing the time required to make a good high strength heat sealed joint. The thermal pad 57 may be a ceramic fiber material. Fiberfrax, a product of the carborundum Corp. has been used successfully in the preferred embodiments, but any suitable heat barrier, preferably the heat reflective type, may be used. A minimum thickness and a width sufficient to overhang the lock plate and paper liner, if used, is desirable. In the preferred embodiment an overhang of 0.5 inch and a thickness of 0.060 inch has been used successfully. The paper liner 54 is terminated short of the lock plate 55. The free end of core band 53 may be looped, as shown at 58 for shackeling to a tensioning ratchet, but this is not necessary. The band may be inserted directly into a ratchet for tensioning. The looped or free end is brought back across the starting end of core band 53, on top of the lock plate 55, and the edges are aligned and the joint area cleaned. The core band 53 is then wrapped about the core leg with a single turn, in a counterclockwise direction, as viewed in FIGS. 2 and 3. The looped or free end 58 is then attached to a ratchet, or other suitable tensioning device, and the band tension adjusted to approximately 1,000 pounds, bringing the core band 53 down so that portions of the core band are firmly in contact with each other over the upper lock plate joint area 59. Tensioning of the core band clamps the core with a sufficient force to compress the core punching stack. Thus, an external core clamping fixture is not necessary. A heat seal is then made with the resin impregnated core band 53, to cure the resin and secure the lapped core band layes together at the lock plate joint area 59. The heat may be applied by any suitable means, such as a preheated electric iron or heater element. The time and temperature will depend upon the resin utilized, with 250° C. for a period of 5 to 8 minutes being suitable for a polyester resin. The pressure applied during the heat seal is approximately 1 lb. per square inch of the joint area.

The impregnated resins subjected to the combination of heat, pressure and the latent catalyst, undergo a thermoset cure wherein the resin linear organic polymer chains become cross-linked and solidify to form a rigidized homogeneous mass, i.e. a solid joint. The liquid state of the resin occurs at a higher temperature than the melt fuse state. The rapid rise to a controlled temperature due to the preheated iron, causes the solidification of the band joint before any resin material can run out of the overlapped portion of the joint. The thermal pad 57 assists in retaining the resin inside the joint area 59 until the resin has cured, and it protects the paper liner from the heat. The resulting heat seal joint will be stronger than the cut-through strength of the core band 53. After the core band joint has been cured, the excess tape would be cut off and the loose end heat sealed down.

An alternate method of forming the heat sealed joint without using resin impregnated bands was tried using a thin super saturated resin sheet or film inserted between non-impregnated core band wraps and then applying heat to form the joint as described above. This method was not successful because of the difficulty of transferring the resin to impregnate the upper band wrap. A variation of the above wherein two thin supersaturated resin sheets were employed, one placed over and one placed under the band area respectively, did produce the desired band joint when heat was applied as described above.

The resin impregnated bands 46 will now clamp and maintain the core shape throughout the remaining manufacturing steps of core up-ending, coil loading, top yoke punching stacking, coil press operations and the hot oil spray treatment of the transformer. During the hot oil treatment step of assembly, the entire assembled transformer is placed under a vacuum and subjected to a spray of oil maintained at a temperature range of 105° C. to 115° C. for a period of approximately 24 hours. The remainder of the core bands, other than the previously cured joint areas, now cure in an oxygen-free atmosphere, under controlled temperature, subject to a vacuum and pretensioning. Under these conditions, the resin linear organic polymer chains become a cross linked homogeneous mass as before but now the cured resin retains a degree of flexibility rather than the rigidized solid of the joint area. The inherent flexibility of the unique curing process enables the band to maintain uniform tension on the core during assembly and operation without cracking or breaking, and without external clamping assistance.

Figure 4:
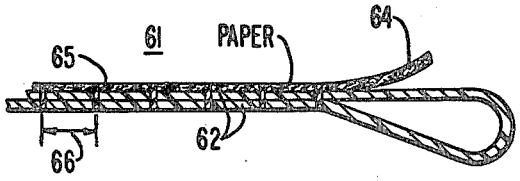
FIG. 4 is an elevation view of a multi-layer unit wrap constructed according to the teachings of the invention.

When it is necessary or desirable to band the core with two or more layers of core band tape or web material, the multiple core band tape or web layers may be combined into a multi-layer unit wrap core band. The unit wrap band may be made prior to the time of application on the core section. Referring now to FIG. 4, a core multi-layer unit wrap band 61 is shown which may have any desired number of layers or tapes or web belts, such as layes 62, and one or more paper liners such as liner 64. The two layer unit wrap band 61 illustrated may be formed by means of looping the tape back over upon itself. For a two layer unit-wrap, the core band length, if individual lengths are to be pre-formed, should be equal to twice the core leg circumference plus four times the lock plate width plus an additional 20 inches. The core bands may include two, three, or four layers, or more, depending upon the total belt thickness desired. In the preferred embodiment of this invention, 0.015 inch and 0.030 inch thick band materials have been used quite successfully, 0.015 inch for a four layer band and 0.030 inch for a two layer band, but other thicknesses would also be suitable. The multiple core band layers may be attached to one another with contact cement, solvent, thread, plastic rivets or staples and also plastic barbed thumbtacks. As shown in FIG. 4, they may be attached at points 65, at suitable intervals 66, along the core band linear length, so that the unit core band material and paper liner may be handled successfully in individual belts or wound on a shuttle for storage.

The method of banding the core laminations with the multilayer unit wrap core band 61 is the same as for the single layer band described above with minor variations. Referring now to FIGS. 2 and 3, one end of the multi-layer unit wrap core band 61 and the paper liner, if separate, would be secured between the lock plate 55 and insulation 56 in FIG. 2. The unit wrap tension would be adjusted to 1000 pounds as described above. Only one thermal heat resisting pad 57 need be inserted. The 250° C. preheated iron would be applied to the overlapping multilayer joint region at the top lock plate area. The heat seal would be formed as described above wherein now the rigidized homogeneous mass would encompass all layers of the multi-wrap at the joint area. Each band wrap layer will be individually fastened to every other band wrap layer, thus each layer will function as an individual band. Each layer will be under uniform tension and contribute the strength and abrasion resistance of an individual band.

In summary, there has been disclosed electrical inductive apparatus having a new and improved non-metallic core band, single or multiple layered, that has the strength and abrasion resistance of a metal band without the short circuit potential and corona problems associated with a metallic band or fastener.

The multi-layer unit wrap core band embodiment functions as multiple individual bands because of the rigidized homogeneous joint which fastens all layers. Multiple core bands without this unique joint were formerly made by encircling several turns, in series, of a core band around the core, tightening and fastening. This method required additional assembly time and resulted in uneven tension forces on the band layers. The outside wrap was subject to most of the tension on the band, while the inside layers were loose and thus of no use.

The non-metallic core band may be tensioned without external core clamping means which reduces manufacturing time and equipment and increases productivity. The core band fastening arrangement and methods disclosed herein provide a quick banding process that is economical, highly reproducible, highly reliable, and produces a joint that occupies the minimal possible space.

The core band disclosed herein provides a low stress core that may be attributed to the uniform clamping pressure that is evenly distributed around the core laminations by the flexible bands under uniform tension. The limited flexibility of the bands, a result of the unique curing method or process disclosed herein, reduces the magnetostriction magnitude and resultant noise level of the core. Correspondingly, the uniform clamping of the disclosed core bands permits the use of new high quality electrical steel grades which have a higher degree of grain orientation and therefore are more sensitive to high stress core assembly. While stress has a relatively small effect on the magnetic characteristics of a core constructed from laminations of hot rolled steel, it has a far greater detrimental effect in a core constructed from laminations of grain oriented steel as it interferes with the grain orientation and causes the flux to deviate from the optimum magnetic path. The efficient use of these higher grades of electrical steel for core punchings will result in reduction of core size and reduction of the overall size of the transformer.

While the preferred embodiments described thus far have been used in transformers, they are not meant to be exhaustive, and the true scope of the invention will apply to any electrical induction apparatus utilizing a magnetic core formed of a plurality of laminations of electrical steel.

I claim as my invention:

1. A method of curing a resin impregnated non-metallic band such that the band retains a degree of flexibility, comprising the steps of:

tensioning the band to a predetermined tension;

subjecting the band to a predetermined vacuum while spraying the band with oil maintained at a predetermined temperature for a predetermined length of time.

2. A method of curing a resin impregnated non-metallic band, comprising the steps of:

providing a magnetic core having a leg portion formed of a plurality of superposed metallic laminations;

providing a non-metallic band impregnated with resin;

wrapping said band about said leg portion, while overlapping at least some portion of itself;

tensioning said wrapped band;

curing resin in said overlapped portion while the band is tensioned to secure the band in the tensioned, wrapped configuration; and curing the remainder of the resin in the band in an oxygen-free atmosphere, to provide flexibility in the portion of the band associated with said remainder of the resin.

3. The method of claim 2 wherein the step of curing the remainder of the resin in an oxygen-free atmosphere includes the step of providing a vacuum about the band.

4. The method of claim 2 wherein the step of curing the remainder of the resin in an oxygen-free atmosphere includes the steps of providing a vacuum about the band, and spraying the band with a predetermined liquid having a temperature in a predetermined range, for a predetermined period of time.

5. The method of claim 2 wherein the step of curing the remainder of the resin in an oxygen-free atmosphere includes the steps of placing the magnetic core and band in a vacuum, and spraying oil having a temperature in the range of 105° C. to 115° C. on the magnetic core and band for a period of approximately 24 hours.

* * * * *